United States Patent [19]

Modery et al.

[11] Patent Number: 4,766,547

[45] Date of Patent: Aug. 23, 1988

[54] COMPUTER CONTROLLED CONVEYOR SYSTEM

[75] Inventors: Richard G. Modery; John C. Bell; Charles R. Cope, all of Grand Rapids, Mich.

[73] Assignee: Transfer Technologies, Inc., Grand Rapids, Mich.

[21] Appl. No.: 851,787

[22] Filed: Apr. 14, 1986

[51] Int. Cl.[4] ..... G06F 15/46

[52] U.S. Cl. ..... 364/478; 198/356; 198/505; 104/88

[58] Field of Search ..... 364/468, 469, 478; 198/340, 341, 349, 356, 502.1, 504, 505; 177/3, 25, 52; 209/592, 593; 104/88; 414/134-136; 211/1.5; 340/901-905, 988-993; 180/167, 168

[56] References Cited

U.S. PATENT DOCUMENTS

| | | | |
|---|---|---|---|
| 3,889,797 | 6/1975 | Naito et al. | 198/35 |
| 4,038,531 | 7/1977 | Loe, Jr. | 198/505 X |
| 4,053,741 | 10/1977 | Ainoya et al. | 364/478 |
| 4,239,434 | 12/1980 | Gannon | 364/478 X |
| 4,240,148 | 12/1980 | Thoma | 364/478 |
| 4,309,600 | 1/1982 | Perry et al. | 364/468 X |
| 4,325,126 | 4/1982 | Thoma | 364/478 |
| 4,346,453 | 8/1982 | Drapeau et al. | 364/900 |
| 4,428,708 | 1/1984 | Burt | 364/444 X |
| 4,472,783 | 9/1984 | Johnstone et al. | 364/478 X |
| 4,484,289 | 11/1984 | Hemond | 364/478 |
| 4,491,189 | 1/1985 | Fukuda | 177/25 X |
| 4,495,584 | 1/1985 | Yoshida | 364/478 X |
| 4,610,361 | 9/1986 | Elliott | 364/478 X |
| 4,620,280 | 10/1986 | Conklin | 364/424 X |
| 4,630,216 | 12/1986 | Tyler et al. | 364/478 |
| 4,669,047 | 5/1987 | Chucta | 104/88 X |

FOREIGN PATENT DOCUMENTS 1550118 3/1976 United Kingdom .

*Primary Examiner*—Joseph Ruggiero

*Attorney, Agent, or Firm*—Price, Heneveld, Cooper, DeWitt & Litton

[57] ABSTRACT

A computer-controlled overhead conveyor system is provided wherein all conveyor vehicles substantially continually communicate with a control system to be routed through the track network. The track is conceptually divided into zones each identified by an optically read marker; and the vehicles include scanners for reading the markers as the vehicles traverse the track. The marker information is communicated to the control system which controls track switches and vehicle velocities to prevent collisions and to direct the vehicles to desired destinations. Preferably, each vehicle includes a circuit for indicating the weight of the load transported thereby; and the control system calculates running totals of material weight moved—for example by material type or by track station. Further preferably, the control system controls the acceleration/deceleration of each vehicle in a manner dependent on the material type and weight to effect the maximum vehicle speeds while preventing damage to vehicle loads.

28 Claims, 5 Drawing Sheets

COMPUTER CONTROLLED CONVEYOR SYSTEM

BACKGROUND OF THE INVENTION

The present invention relates to computer controlled conveyor systems, and more particularly to such systems capable of routing conveyor vehicles to selected destinations and preventing intervehicle collisions.

A wide variety of conveyor systems have been developed incorporating computers and/or communication systems for various purposes. One particularly useful system is that sold by the assignee of the present invention under the trademark CARTLING. This system includes an overhead conveyor track network and a plurality of self-propelled vehicles confined to the network for movement therealong. The track network is conceptually divided into segments, and a hardware logic module is associated with each segment. Circuit cards are provided, and each interconnects up to four hardware logic modules. If a vehicle is present on a segment and drawing current, the associated hardware logic module registers a "present signal" so that the circuit card knows that a vehicle is present on that segment. The circuit cards "block" one or more track segments behind the "vehicle present" segment to prevent intervehicle collisions. The vehicles are identified by an FM signal superimposed on the drive/block signal. Code readers at switches identify the vehicles and make switching decisions in response thereto. A central control computer is provided, and the various circuit cards and switching stations are hard-wired to each other and serially to the central computer to insure that vehicles are delivered to desired destinations.

Although constituting a significant advance, the CARTLING system is not without its drawbacks. Most significantly, the system is "wire intensive" requiring an extensive network of wires to interconnect the hardware logic modules, the circuit boards, the switching stations, and the central control computer. Such wiring is extremely complicated and therefore expensive. Further, such wiring is difficult to service and any modification to the system requires extensive rewiring.

Although computers have been integrated into other conveyor systems for various purposes, these computer systems do not provide the desired communication and/or control for present day manufacturing and warehousing environments.

It is often desirable to weigh conveyed articles in a conveyor system. Weighing is typically accomplished by providing a weigh station and routing the articles to be weighed through the station. This arrangement has several drawbacks. First, articles to be weighed must be shuttled through the station, often requiring additional conveying time. Second, the weight of the article is determined only at the time of its presence at the weigh station. Weights at other times must be assumed.

SUMMARY OF THE INVENTION

The aforementioned problems are overcome in the present invention providing a conveyor system with improved computer and communications control to constantly monitor the position of vehicles within the system and to deliver vehicles to desired destinations. Specifically, the system includes a conveyor track network, a communication bus extending along the track network, a plurality of self-propelled vehicles confined to the network and coupled to the communication bus, and a computer control system coupled to the communication bus. The vehicles are capable of identifying their location within the network, and the computer is capable of polling the individual vehicles to acquire this location information. The computer makes routing decisions (1) to control switching stations and thereby deliver vehicles to their desired destinations and (2) to prevent collisions between vehicles.

Preferably, the control system is also capable of varying each vehicle speed independently to deliver the vehicles to their desired destinations with minimum delay. Further preferably, the computer control system is hierarchical, including a central supervisor communicating with multiple slave computers. Such a configuration provides the flexibility to install and/or implement software functions at the optimal level within the hierarchy to take advantages of hardware technologies.

The described system is greatly simplified over known constructions. Specifically, the system includes a single two-conductor communication bus extending along the track in place of the previous requirement of hard wires for each individual track segment. The communication bus enables the computer to continually poll and communicate with the individual vehicles traversing the system. By continually monitoring the position of the vehicles, the control system can most efficiently prevent intervehicle collisions and route each vehicle to its individual destination.

In a second aspect of the invention, selected vehicles include one or more sensors for measuring one or more desired characteristics (e.g. weight, temperature, or pressure) of the material transported by the vehicle and a system for communicating this information to a central computer. In the preferred embodiment, the sensor is a load sensor, and the computer maintains a log of the material weight moved by the vehicles within the system. Preferably, this log includes cumulative totals of such weights for example by vehicles, start stations, destination stations, material types, or order numbers. Such monitoring greatly improves management activities associated with the conveyor installation by providing exact and up-to-date material weight information. This monitoring also provides manufacturing process history and information indicative of efficiency.

In a third aspect of the invention, the control system is capable of providing speed commands to the individual vehicles. Consequently, the speed of each individual vehicle is carefully and precisely controlled to meet optimal material movement criteria including consistent spacing between vehicles. Preferably, the speed commands are responsive to the load weight so that heavier vehicles are accelerated and/or decelerated more slowly than lighter vehicles. Preferably, speed is also responsive to material type information to accelerate fragile materials more gently than rugged materials. The speed can also be responsive to any other vehicle sensor information as desired. This control system enables each vehicle to be moved as rapidly as possible through the system while still being sensitive to the load weight and/or material type carried by each vehicle.

These and other objects, advantages, and features of the invention will be more fully understood and appreciated by reference to the drawings and the detailed description of the preferred embodiment.

DETAILED DESCRIPTION OF THE PREFERRED EMBODIMENT

I. System Overview

Figure 1:
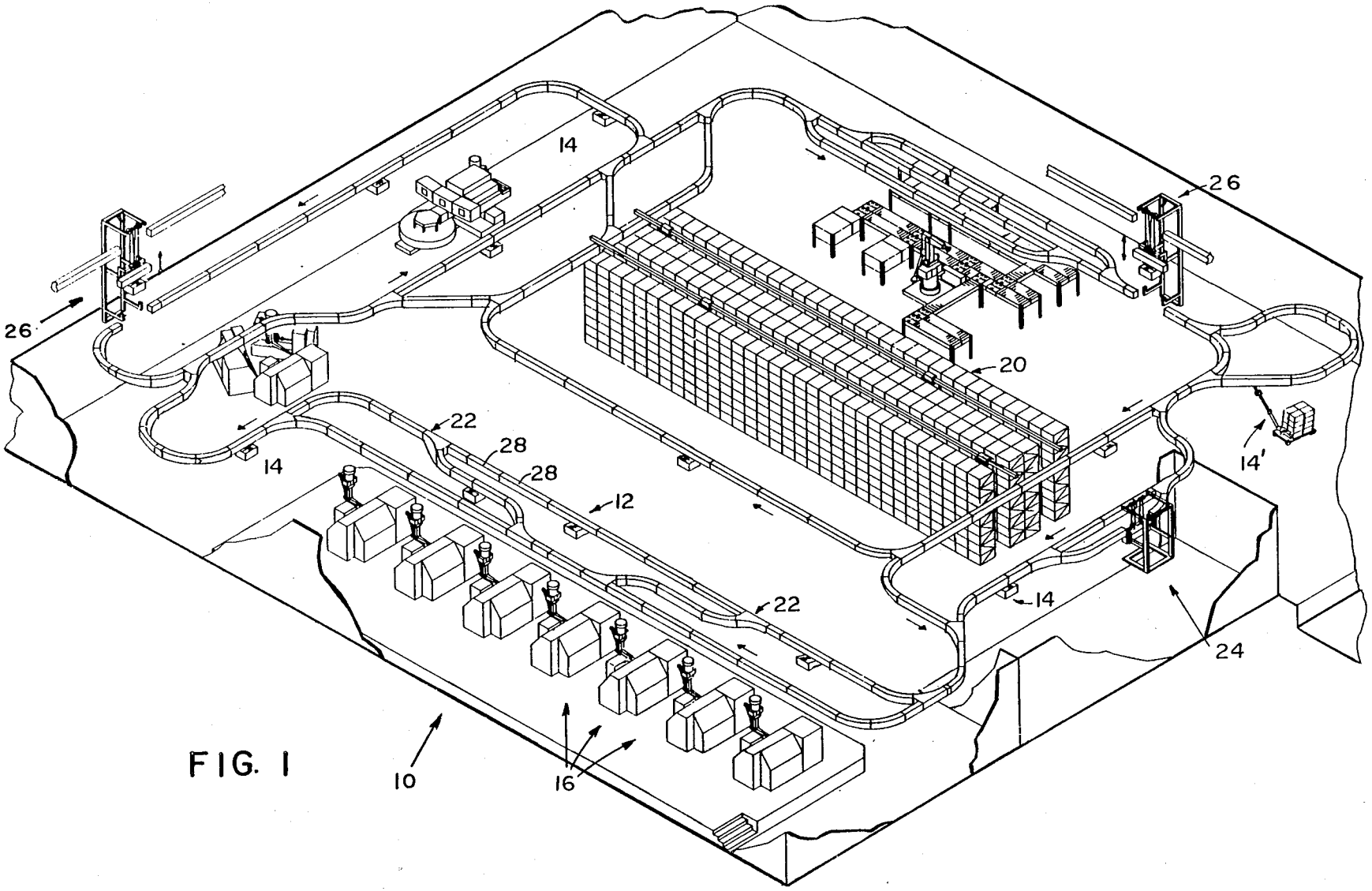
FIG. 1 is a perspective view of the conveyor system of the present invention installed within a factory.

A conveyor system constructed in accordance with a preferred embodiment of the invention is illustrated in FIG. 1 and generally designated 10. The system includes an overhead conveyor track network 12 and a plurality of material handling vehicles 14 confined thereto and traveling therealong. The layout of conveyor track 12 of course depends on the demands of a particular installation. For example, the system 10 in the present invention is configured to interact with PLC's or machine tools 16, and an automatic storage and retrieval system "AS/RS" 20. The system 10 can optionally also interact with loading stations, unloading stations, pick-up stations, and drop stations. The system 10 further includes switches 22 to divert and merge the vehicles 14 to and from various track paths. The illustrated system also includes a service lift 24 for installing vehicles into, and removing vehicles from, the conveyor track 12. Vertical lifts 26 are further included to transfer the vehicles 14 between conveyor tracks 12 of different heights.

The track network 12 is conceptually divided into a plurality of track zones 28. As will be described, the presence of a vehicle 14 on any track zone 28 prevents any other vehicle from moving in the zone immediately therebehind to prevent collisions between vehicles. Additionally, computer control is provided to regulate the switches 22 and the vehicles 14 to convey each vehicle to a selected destination. Although the network shown is endless, there may be occasions where a spur path (FIG. 8) may terminate.

II. Material Handling Vehicles

Figure 10:
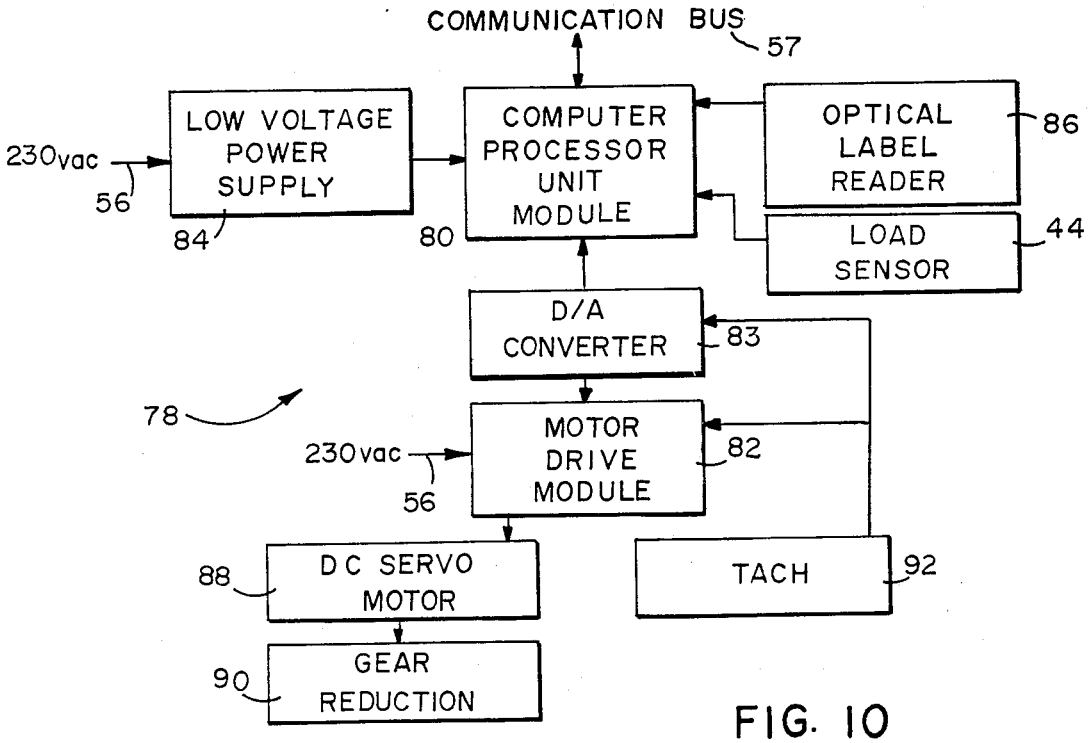
FIG. 10 is a schematic diagram of the onboard computer control within each vehicle.

A material-handling vehicle 14 (FIGS. 1–5) includes a drive unit 30 and a product carrier 32 suspended therefrom. The physical structure of the drive unit 30 does not comprise the present invention and will be only briefly described herein. The drive unit 30 (FIGS. 2 and 3) includes a driving motor 88 and a housing 34 in which is mounted the control circuitry (see FIGS. 10 and 11). The control circuitry does comprise part of the present invention as will be discussed. The drive unit 30 further includes drive wheels 39 driven by the motor to propel the drive unit through the track network 12. The drive unit further includes four pairs of guide-wheels 36 (only one of each pair shown) which position the drive unit within the track network 12 and also follow guides in the switching stations 22 to properly route the vehicle through the network. Preferably, a sonic detector (not shown) is included at the forward end of the drive unit 30 to detect objects located in front of the vehicle 14 and prevent collisions with articles and people on the factory floor. Other sensors which could also be used include infrared (IR), video, radar, laser, and/or proximity sensors. Bumpers 38 are provided for protection in case of intervehicle collisions.

Figure 4:
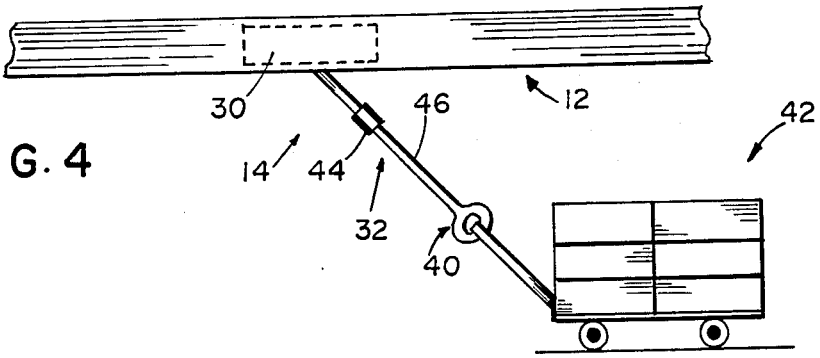
FIG. 4 is an elevational view of a vehicle for towing a wagon 4-wheel pallet or train.
Figure 5:
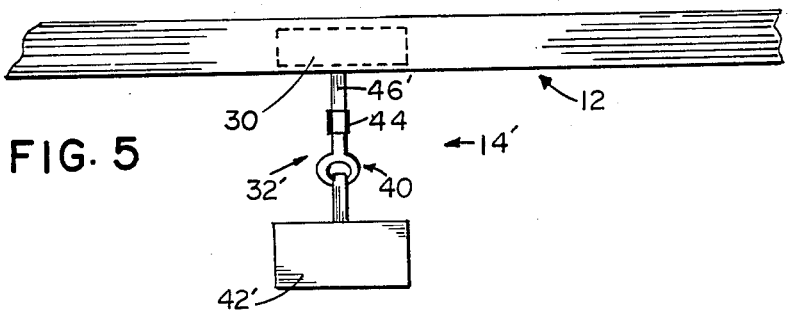
FIG. 5 is an elevational view of a vehicle for a suspended load.

Basically two types of material handling vehicles are provided as illustrated in FIGS. 4 and 5. The first type of vehicle 14 (FIG. 4) includes a drive unit 30 within the track network 12 and a product carrier 32 suspended therefrom. The product carrier 32 includes a hook or coupling 40 or other means for releasably receiving the handle of a wagon 42. A load sensor or strain gauge 44 is located within arm 46 between the drive unit 30 and the coupling 40. Alternatively, the load sensor could be incorporated into the mounting assembly interconnecting the arm 46 and the drive unit 30. Consequently, the resistance provided to the drive unit 30 by the wagon 42 registers as a force on the gauge 44 for use as will be described. A second type of vehicle 14' (FIG. 5) includes a drive unit 30 within the track 12 and a product carrier 32' suspended from the drive unit. The carrier includes a hook or jaws 40 and a strain gauge 44 within the arm 46 extending between the drive unit 30 and the jaws 40. This load sensor could also be incorporated into the interconnection of the arm 46 and the drive unit 30. The jaws 40 releasably receive a suspended load 42'; and the strain gauge 44 therefore provides an indication of the weight of the load. Other sensors can be included on the vehicle as desired to monitor temperature, pressure, or virtually any other load or vehicle parameter. This weight or other sensor information is utilized as will be described.

III. Conveyor Track Network

A. Overview

The track network 12 is most fully illustrated in FIG. 1 and is conceptually divided into zones 28. While the zones 28 are delineated in the drawing by lines extending transversely to the direction of the conveyor track, these lines do not physically exist on the conveyor track. An optically read bar code label (not shown) is positioned precisely at the beginning of each zone and includes an identification number unique to the "block" in which it is located as will be described. The vehicle includes an optical reader (see FIG. 10) which scans and reads the bar codes as the vehicle travels through the network 12 to identify the track zone on which the vehicle is located. The length of the track zones vary but typically are each two meters long. Each zone 28 can currently perform up to four zone functions selected from 18 zone function types, as will be described, to perform various track functions such as switching, merging, or positioning. New zone functions can be added as necessary to implement other functions as they may be required.

Figure 2:
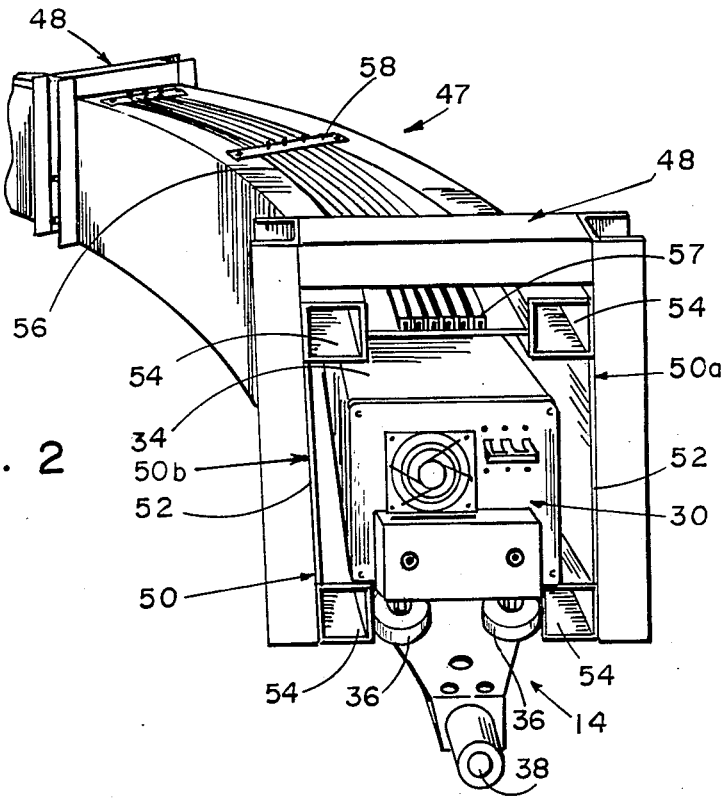
FIG. 2 is a perspective view of one of the vehicles within the overhead conveyor track.
Figure 3:
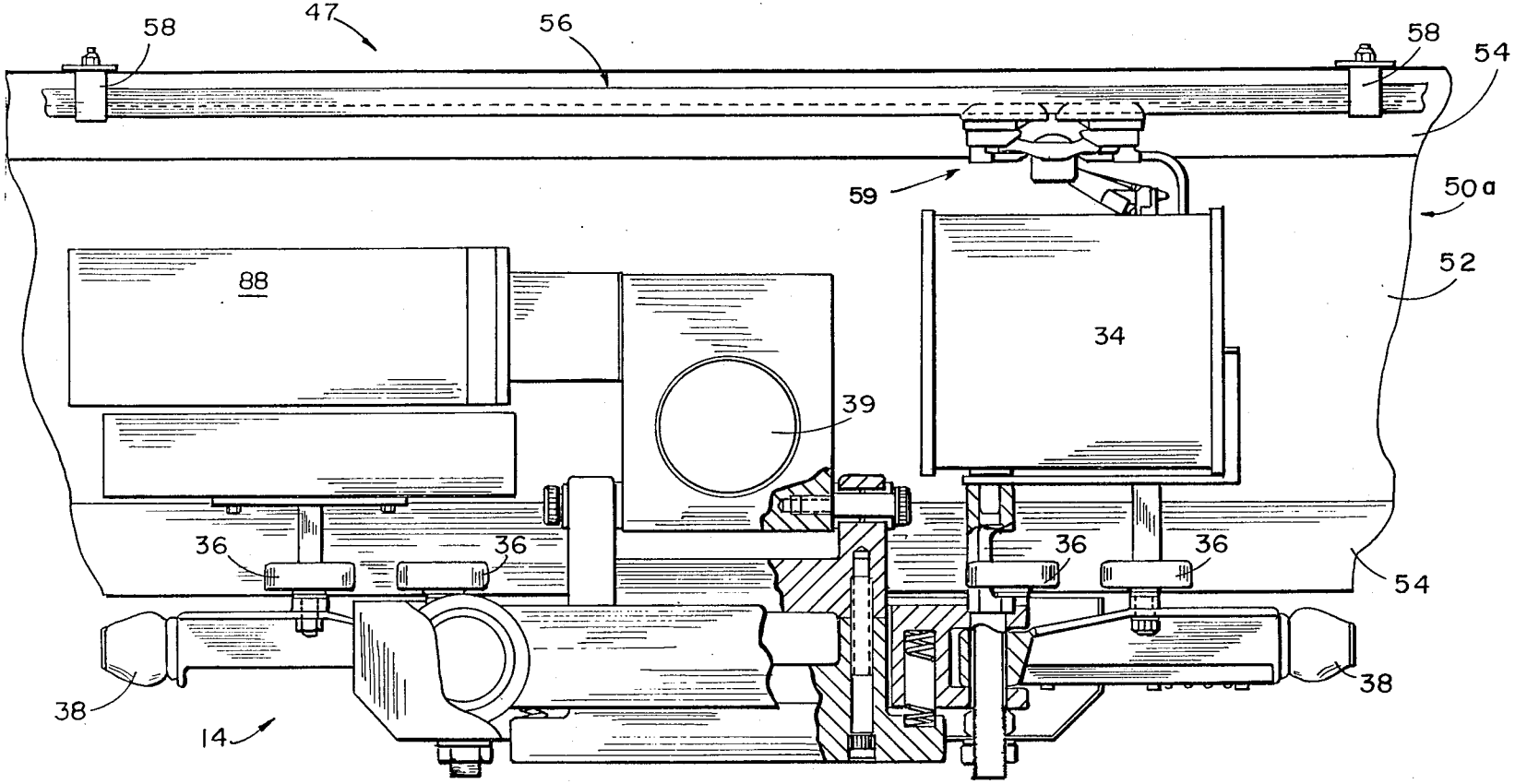
FIG. 3 is a side elevational view of a vehicle within the track.
Figure 9:
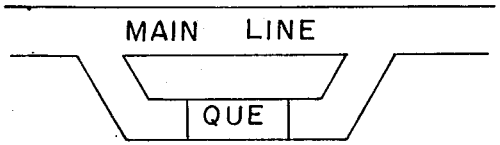
FIG. 9 is a schematic diagram of a fourth exemplary track zone layout.

The construction of the track 12 is illustrated in FIG. 2. The track 12 includes a plurality of pieces 47 suspended between hangers 48. Both the track pieces 47 and the hangers 48 are of conventional construction to suspend the track network 12 above the factory floor. Each piece 47 includes a pair of opposite identical sides 50*a* and 50*b*, which in turn each include a side wall 52 and upper and lower tubular supports 54. Alternatively, each side 50 can be roll formed to provide the internal track shape illustrated in FIG. 2.

Preferably, a six-conductor power and communication bus 56 is located between the upper members 54 and is suspended on hangers 58 which rest on the upper members. Three conductors of the bus provide three-phase 230-volt power; one conductor provides an earth-ground for safety; and two conductors provide a communication bus 57. The communication bus 57 is segmented with each bus segment extending the full length of a "block" of zones to be described. The vehicles include a fingered shoe assembly 59 (FIG. 3) extending into and spring-loaded into engagement with the bus 56 to be in operative contact therewith.

Each of the zones 28 is selected from 18 currently defined zone types. These zones (FIGS. 6–9) are identified by the following symbols which correspond to the following full names:

| Zone Function Symbol | Zone Function Name |
|---|---|
| BO | Block Out |
| RZ | Regular Zone |
| MST | Main Switch Test |
| MSI | Main Security In |
| SCI | Switch Control In |
| SMI | Switch Main In |
| MTO | Main Test Out |
| MOSS | Main Out Slide Security |
| SCO | Switch Control Out |
| SMO | Switch Main Out |
| SSI | Switch Siding In |
| AP | Approach Point |
| SP | Stopping Point |
| STO | Switch Test Out |
| SOSS | Siding Out Slide Security |
| BI | Block In |
| SSP | Spur Stopping Point |
| QUE | Queue |

An installation is created by first defining the interactive points including loading point, stopping points, unloading points, and transfer points. The physical track, including a main path and subpaths or spurs, is then laid out to effect the desired material transfer between these points as illustrated for example in FIG. 1. Track zones are then defined preferably about every two meters of track length. Finally, zone functions are assigned to each track zone to meet the functional requirements of the track layout.

IV. Control System

A. Overview

The control system 60 (FIG. 6) includes a command processor computer (CPC) 62, a communication bus 64, and a plurality of block control computers (BCC's) 66. One CPC 62 is provided for each system 10; and BCC's 66 are provided as necessary each currently controlling up to 16 track zones 28, also referred to as a block. As currently designed, the CPC 62 is capable of communicating with currently 256 BCC's 66 to control a current maximum of 4,096 track zones 28. The CPC 62 communicates with the BCC's 66 via bus 64 which is an RS422 multi-drop bus. The BCC's communicate with the vehicles 14 via the segmented bus 57 which is an RS-485 bus.

B. Command Processor Computer

The command processor computer (CPC) 62 (FIG. 6) in the preferred embodiment is a model 5531 sold by International Business Machines (IBM) of Armonk, N.Y. It is anticipated that systems including more than 32 blocks will require a larger CPC such as an IBM PC-AT, DEC VAX, or TI BUSINESS PRO. The CPC 62 includes means for communicating with the remainder of the factory communication network 68 vla a separate data communication bus 70. A printer 72, CRT (not shown), and keyboard 74 are coupled to the CPC 62 in conventional fashion to provide input/output (I/0).

The CPC maintains several dynamic tables in its storage. The first table is a "block status" table including a record for each block in the system. The second is a "vehicle" table which includes a record for each vehicle within the system 10. Command and request buffer tables are provided and contain spooled commands to the BCC's and from the stopping/loading points. A routing table is provided and contains a list of each stopping/loading point. Error tables are also provided to give descriptive messages when unresolvable erors are detected.

The block status table record includes the following entries for each track zone in the block:

| Entry | Description |
|---|---|
| Zone Number | Identification of zone within the block |
| Vehicle Number | Identification of vehicle in the zone |
| Vehicle Status | Flag set to indicate the vehicle's movement status |
| Loading Point Status | Flag set to indicate the status of a loading point zone |

The vehicle table includes the following entries for each vehicle within the system 10:

| Entry | Description |
|---|---|
| Vehicle Number | Unique identifier for the vehicle |
| Current Location | Identification of the block and zone in which the vehicle is traveling |
| Destination | Identification of block and zone to which the vehicle is ultimately traveling |
| Vehicle Allocated Flag | Flag set to indicate that the vehicle is allocated to a specific task |
| Load Type | Identifies the type of the material being conveyed by the vehicle |
| Load Weight | Indicates the weight of the material being conveyed by the vehicle |

The CPC dynamically maintains the vehicle table to provide status information reguarding each vehicle in the system 10

C. Block Control Computer

One block control computer (BCC) 66 is currently provided for up to 16 contiguous track zones 28. The BCC 66 in the preferred embodiment is a microcomputer including an Intel 8085 microprocessor, a double UART (universal asynchronous receiver/transmitter), and a port/timer chip all made by Intel Corporation of Santa Clara, Calif. This microcomputer is based on STD bus. The track zones controlled by one BCC are referred to as a "block" of track zones. One segment of the two-conductor bus 57 extends the full length of the block to provide communication between the BCC 66 and all vehicles present within the block.

The BCC currently maintains two tables. The first is a "zone" table including a record for each zone in the block; and the second is a "flag" table including flags for all zones in the block.

The zone table record is as follows:

| Entry | Description |
|---|---|
| Block Number | Unique identifier of the block |
| Zone Number | Unique identifier of the zone within the block |
| Zone Function One | Identification of a first zone function |
| Zone Function Two | Identification of a second zone function |
| Zone Function Three | Identification of a third zone function |
| Zone Function Four | Identification of a fourth zone function |
| Current Vehicle | Identification of the vehicle in the zone |
| Passed-In Vehicle | Identification of vehicle expected to be received in the zone |
| Passed-Out Vehicle | Identification of vehicle passed to the next zone |
| Reply Vehicle | Identification of vehicle replying to a polling request |
| Speed Limit | Maximum speed permitted in zone |
| Command Speed | Present speed command to vehicle |
| Vehicle Status | Flag indicating driving, halted, or positioning |

The zone table is dynamically maintained by each BCC in response to its polling of the individual vehicles within the block as will be described.

The CPC 62 configures the speed limit of each zone 28 to be controlled by the BCC 66. The actual vehicle speed is responsive to the configured speed limit, the vehicle "Load Weight", and the vehicle "Load Type" as recorded in the CPC vehicle table. The speed profile for heavily loaded vehicles is selected to accelerate and decelerate such vehicles relatively slowly to comport with the vehicle's physical capabilities. The speed profile for vehicles with relatively fragile materials is selected to handle the fragile materials gently. It is currently anticipated that each vehicle will be capable of driving at sixteen different speeds.

The flag table comprises a plurality of 16-bit words organized as flags. Each bit in each word corresponds to one of the zones within the block. The flags perform the following functions:

| Flag | Description |
|---|---|
| Zone Blocked | Bit set indicates that the zone is blocked causing a halt command to be sent to the vehicle within this zone |
| Interzone Transfer | Bit set indicates that a vehicle is being transferred to the next zone |
| Zone Polled | Bit set indicates which zone is being polled-only one bit may be set at any given time |
| Vehicle Present | Bit set indicates that a vehicle is present in the zone |
| Vehicle Driving | Bit set indicates that the present vehicle is moving within the zone |
| Zone Warning | Bit set indicates that a vehicle poll failed |

The tables maintained by the BCC's are periodically uploaded to the CPC in response to block polling requests from the CPC.

Figure 6:
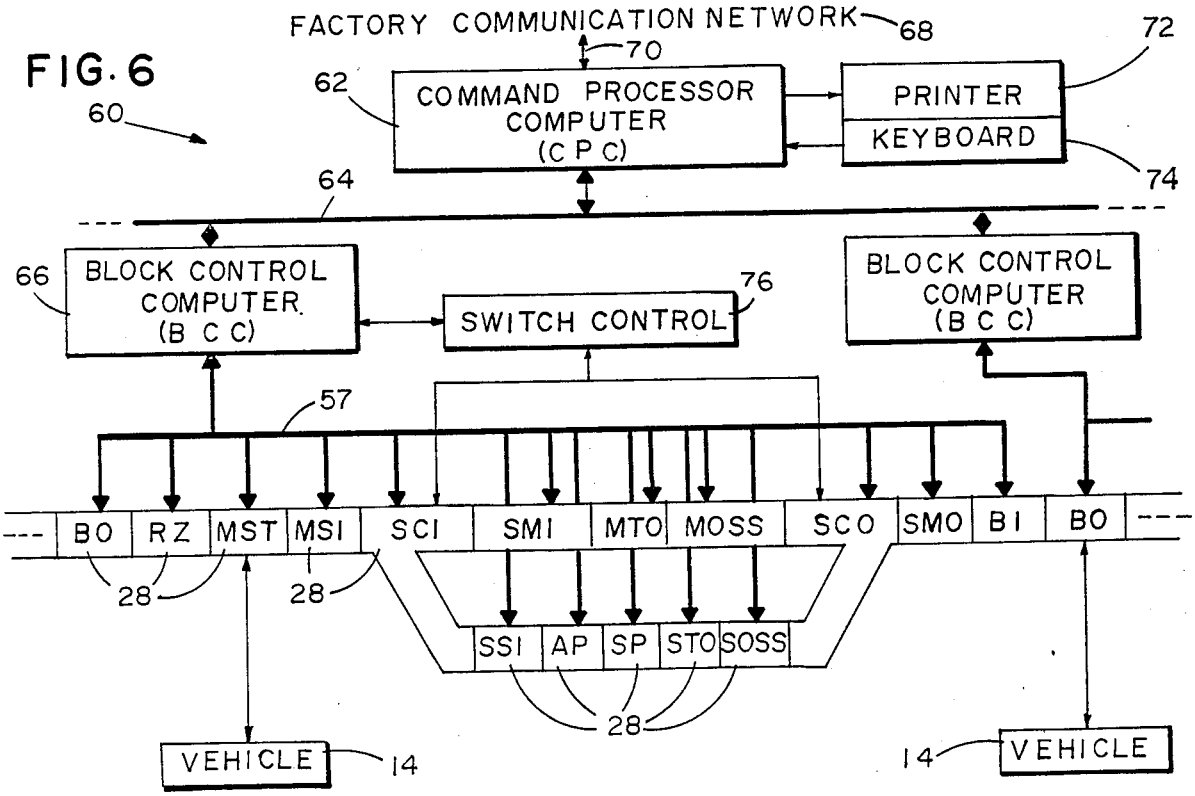
FIG. 6 is a schematic diagram of the computer control system and an exemplary track zone layout.
Figure 7:
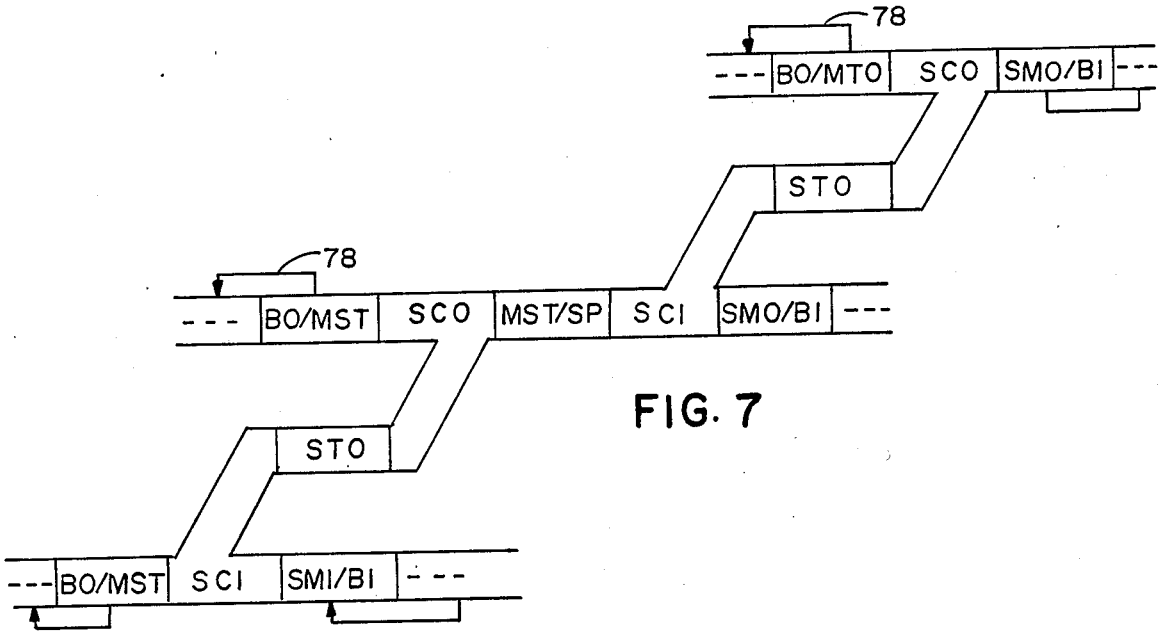
FIG. 7 is a schematic diagram of a second exemplary track zone layout.
Figure 8:
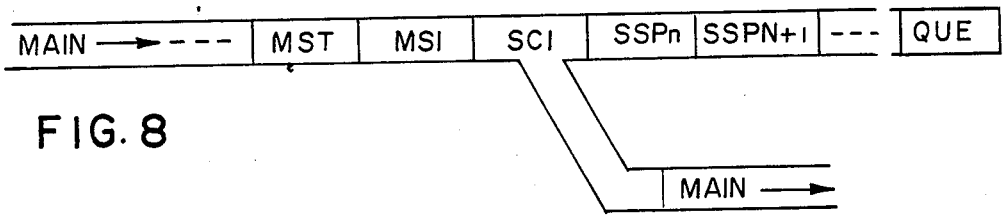
FIG. 8 is a schematic diagram of a third exemplary track zone layout.

Typical block layouts are illustrated in FIGS. 6–8. As mentioned above, the type of each zone is dictated by its placement within the track network 12 and will be readily apparent from the following description of the function of each zone. A large number of zone layouts is possible depending on the selection and placement of the zones within the block. The block can include up to four switches (see FIG. 6) all responsive to the BCC 66 through the switching control 76. A relatively complex configuration is illustrated in FIG. 7 and includes four switches and 16 zones, several of which perform multiple zone functions.

All switches within the system are checked through the switch control 76 for proper position before activation Additionally, the switches are again tested after activation to insure that they have moved to the proper position.

All polling performed by the BCC's 66 occurs between a vehicle 14 and a BCC via the communication bus 57 (FIG. 6). The vehicles 14 are in constant communication with the bus segment 57 associated with the BCC 66 of the block in which the vehicle is located. A "zone poll" is sent out on the bus 57, addressing one zone at a time. A zone poll is a formatted command with a zone identifier. All zones (1) containing BO and BI functions, (2) having vehicles present, and (3) having blocking flags set are zone polled. Failure to respond to a zone poll by a vehicle known to be present, as ascertained from the tables, sets the zone warning flag and initiates a "vehicle poll". A vehicle poll is a formatted command with a vehicle identifier and is also sent out on the bus 57 addressing a specific vehicle. The primary function of the vehicle poll is to pass vehicles between adjacent zones. If a vehicle fails to respond to a vehicle poll, the zone warning flag is not reset, initiating a "wildcard" poll.

A wildcard poll is sent out on the bus 57, addressing any vehicle that has failed to respond to a zone poll and a vehicle poll. If no Zone Warning flag is set, a default widcard poll is sent, which addresses any vehicle that has not responded to a previous poll. The primary purpose of wildcard polling is to resolve problems indicated by Zone Warning flags. The default wildcard poll finds lost and/or new vehicles in the block.

The CPC 62 polls the individual BCC's 66 periodically to update the tables maintained in the CPC and to respond to requests for vehicles. The CPC in turn issues commands to the individual BCC's to route vehicles to specific stopping points to maintain dynamic vehicle control within the system.

D. Zone Functions

Each zone performs at least one function as described below. All zones perform a "blocking" function. Specifically, if the BCC 66 determines that a vehicle is present in any zone, the ZONE BLOCKED flag for the immediately preceding zone is set to prevent vehicles from moving in that preceding zone. Consequently, inter-vehicle collisions are prevented by preventing vehicles from moving in adjacent track zones anywhere in the system.

Block Out (BO) Function

The block out function must be used in all zones which are adjacent to previous blocks. As a vehicle passes from the previous block into the present block, the BO function acquires the vehicle identification and sets the BO discrete output line (e.g. 78 in FIG. 7). This output is wired to the previous block's last zone (BI function) to provide blocking continuity. BO zones are always zone polled.

Regular Zone (RZ) Function

Any zone which does not require a special function defaults to the RZ function. This function performs normal blocking procedures. If a vehicle is present in the zone, the BCC blocks the zone directly preceding. If the zone has not been blocked by the next zone, a drive command is sent to any vehicle in the zone.

Main Switch Test (MST) Function

This function is required two zones before an input switch. If a vehicle is present in the zone, the preceding zone is blocked. The current vehicle identification is checked to see if it should be routed into the secondary path of the in switch. If so, the switch status is tested for present position and "busy" status. If "busy" is active, the vehicle is stopped. When "busy" is reset, the switch is commanded to move into the secondary position. The speed limit is normally less than that of a normal main track zone to prevent load sway. If no vehicle is present in the zone, no function is performed.

Main Security In (MSI) Function

This function is required one zone before an input switch. If a vehicle is present in the zone, the preceding zone is blocked. If the in switch is not in the proper position, the vehicle is stopped. If the switch is not busy and in the wrong position, a malfunction flag is set. This information is sent to the CPC during a block status upload. Otherwise, if the zone is not blocked, the vehicle is driven through the zone. If no vehicle is present, no function is performed.

Switch Control In (SCI) Function

This function is required for zones physically encompassing an input switch. If a vehicle is present in the zone, the preceding zone is blocked and switch control logic is inhibited.

Switch Main In (SMI) Function

This function is required one zone after an input switch, on the main track. If a vehicle is present in the zone and the switch is in the main position, the preceding zone is blocked. Otherwise, no zones are blocked.

Main Test Out (MTO) Function

This function is required on the main track two zones before an output switch. If a vehicle is present in the zone, the preceding zone is blocked. If the output switch is not in the main position, the vehicle is stopped. Otherwise, the vehicle proceeds through the zone. If a switch priority flag is set in the CPC configuration, vehicles leaving a side track are blocked until the main traffic clears to maintain maximum main track throughput.

Main Out Slide Security (MOSS) Function

This function is required on the main track one zone before an output switch. If a vehicle is present in the zone, the preceding zone is blocked. If the output switch is not in the main position, the vehicle is stopped. Otherwise, the vehicle proceeds through the zone.

Switch Control Out (SCO) Function

This function is required for all zones physically encompassing an output switch. If a vehicle is present in the zone, preceding MOSS and SOSS zones are blocked and switch control logic is inhibited to prevent movement of the switch mechanism while a vehicle is driving through the zone.

Switch Main Out (SMO) Function

This function is required on the main track one zone after an output switch. If a vehicle is present, either the preceding MOSS or SOSS zone is blocked depending on the switch position, If the switch is in the main position, no other function is performed. If the switch is in the secondary position, it is commanded to return to the main position.

Switch Siding In (SSI) Zone

This function is required on the secondary track one zone after an input switch. If a vehicle is present and the in switch is in the secondary track position, the SCI and MSI zones are blocked and the switch is returned to the main position. Otherwise, no further function is performed.

Approach Point (AP) Function

This function is required one zone before a stopping point zone. If a vehicle is present in the zone, the preceding zone is blocked. If the vehicle is assigned to the next stopping point zone, the vehicle is decelerated in preparation for servo positioning at the stopping point.

Stoppinq Point (SP) Function

This function is required by all zones encompassing a stopping point. If a vehicle is present in the zone, the preceding zone is blocked. If the present vehicle has been assigned to stop, a "position" command is sent to the vehicle, enabling a servo positioning procedure. When the vehicle has reached its stopped position, it returns a stop status to the BCC. The BCC sets a discrete output, indicating that the vehicle is ready for unloading. Two discrete inputs (not shown) are provided at each stopping point to interface with loading and unloading equipment. The BCC logic associated with these discretes can be configured to structure loading schemes accommodating the process at the stopping point. Loading schemes may include, for example, timed stops and actuation of vehicle-controlled product hoists. When a vehicle is not present in the zone, the two input discretes and an output discrete are used to allow an operator or programmable device to request materials or empty vehicles at the stopping point. A request is forwarded from the BCC to the CPC where a material routing decision is made.

Switch Test Out (STO) Function

This function is required on the secondary track two zones before an output switch. If a vehicle is present in the zone, the preceding zone is blocked. If no vehicle is present in the associated MOSS and SCO zones, then the MOSS zone is blocked and the associated output switch is commanded to switch to the secondary track position. Until the switch is in the siding position, the associated SOSS zone is blocked. If the switch priority flag is not set by the CPC configuration, vehicles on the main track are blocked until traffic leaving the side track clears to give priority to side track traffic.

Siding Out Slide Security (SOSS) Function

This function is required on the secondary track one zone before an output switch. If a vehicle is present in the zone, the preceding zone is blocked. If the vehicle is moving, the associated MOSS zone is blocked. If the switch is not in the siding position, the SOSS zone is blocked until the switch reaches the siding position.

Block In (BI) Function

This function is required in all zones which are adjacent to a new block. If a vehicle is present in the zone, the preceding zone is blocked. A BI zone gets its blocking flag from a discrete input (e.g. 78 in FIG. 7) which is wired to the associated BO zone in the next block. When BI loses communications with a present vehicle, it sets a timer and watches for an active blocking signal from the next block. If the timer times out, a zone warning flag is set.

Spur Stopping Point (SSP) Function

This function is used to back vehicles onto the main track from a storage spur (FIG. 8). It is required in all zones on the spur track. If a vehicle is commanded to move from storage to the main track, the following procedure occurs. The BCC checks the status of the MST, MSI, and SCI zones. If vehicles are not present on any of these zones, the MST zone is blocked and the switch is commanded to the secondary position. The vehicle is commanded to the reverse mode and driven through SCI and into the MSI zone. The vehicle is halted, the switch is commanded to the main position and the vehicle is commanded to the forward mode. The vehicle now proceeds on the main track.

Queue (QUE) Function

This function is used to store multiple vehicles in one zone and is the only function permitting vehicles to move in adjacent zones, or even the same zone. Empty and/or loaded vehicles can be stored and/or queued as desired. Queuing is first-in-first-out (FIFO) if the queue area has an entrance and an exit on the main path (FIG. 9) and is last-in-first-out (LIFO) if the queue area has only one path to the main path (FIG. 8).

V. Vehicle On-Board Control

The on-board control for each vehicle 14 is generally denominated 78 (FIG. 10) and is a microprocessor-controlled, closed loop DC motor drive system. The control primarily includes a computer processor unit module (CPUM) 80 and a motor drive module (MDM) 82. The CPUM 80 is a functional single board microcomputer including a microprocessor, RAM (random access memory), ROM (read only memory), an I/0 (input-/output) port timer, a memory decoding unit, a dual UART, a dual baud-rate generator, and communication drivers. The low voltage power supply (LVPS) 84 converts the 230-volt AC power supply to a five-volt DC supply usable by the CPUM 80.

A conventional optical label reader 86 is provided and coupled to the CPUM 80 to read the optical bar code type labels identifying the track zones, to read servo position lables (not shown), and to derive short-term vehicle speed. Other labels and readers could be of the laser, magnetic, or proximity type. The CPUM assumes that it is on the zone identified by the last bar code read. Appropriate error handling capabilities can be added to the CPC, BCC, and/or vehicle to make decisions when it is determined that a vehicle is on a zone other than that identified by the last bar code read. The CPUM 80 is capable of determining the vehicle speed based upon the time required to read the optical bar code.

The load sensor 44 is included within the product carrier arm 46 (see FIGS. 4 and 5) to provide an indication of the weight of the load transported by the vehicle. For a "dragging type" vehicle 14 (FIG. 4) the strain measured by the load sensor 44 must be converted to an appropriate estimate of the weight on the wagon 42. For a "suspension-type" vehicle 14', the load sensor 44 provides a direct indication of the load weight. The weight of the load is utilized in accelerating and decelerating the vehicle as will be described to effect rapid movement of the vehicles through the system while being sensitive to the load type and weight. Other sensors can be provided on the vehicle to monitor in-process characteristics and/or parameters of the load and-/or vehicle such as temperature, pressure, humidity, pH, or chemical composition. The information from these sensors is transmitted to the CPC for adaptive control decisions, such as routing or vehicle speed, or to be logged and reported.

The CPUM 80 (FIG. 10) is coupled to the communication bus 57 to provide communication with the block control computer (BCC) 66 (see also FIG. 6). Each vehicle 14 is identified by a unique identification number. Therefore, each vehicle can be polled by the BCC by sending out a polling signal over bus 57 identifying the vehicle by number and issuing a movement command. In response, the vehicle 14 confirms the command; returns its location as read from the optical labels on the track zones; and, if requested, returns the load weight as sensed by the load sensor 44.

The CPUM 80 (FIG. 10) further includes an internal clock/timer (not specifically shown) to insure that the vehicle is periodically polled. The timer is reset to zero each time that the vehicle is polled. If one second, or other predetermined time period, elapses before the vehicle is polled again, the CPUM 80 issues a signal to stop the vehicle.

The motor drive module (MDM) 82 (FIG. 10) regulates the speed of the drive motor through pulse width modulation. The vehicle drive commands received from the CPUM 80 through the D/A digital-to-analog converter 83 are utilized to control a pulse width modulator DC converter incorporated within the MDM 82. The MDM 82 includes the electronic circuits for conversion of the three-phase AC input voltage received via the bus 56 into pulse width modulated (PWM) high-voltage DC for powering the vehicle drive motor.

A park brake can be set on the vehicle by shorting out the motor through the MDM 82. The motion of the vehicle must be determined to be zero before the parking brake can be set.

The vehicle 39 can also include servo motors (not shown) for raising and lowering the product carrier arm 46 or 46'. If such servos are included, they are also controlled using a PWM scheme.

The DC servo motor 88 (FIG. 10) drives the high-friction vehicle wheels (not shown) through a gear reduction unit 90. The vehicle drive motor is a permanent magnet direct current (PMDC) servo motor with an integral DC tachometer 92 for speed sensing. The drive shaft of the motor mechanically mounts to a step down differential gear reduction housing 90 to drive the vehicle wheels.

Optionally, a data entry controller (DEC) (not shown) is provided on each vehicle enabling a person to select the destination of the vehicle from the factory floor. Such controls are generally well-known in the art and typically include a manually selected numeric input. This destination is communicated from the DEC to the CPUM 80 (FIG. 8) to the BCC 66 to the CPC 62 (see FIG. 6) so that the vehicle is routed to the selected destination.

Figure 11:
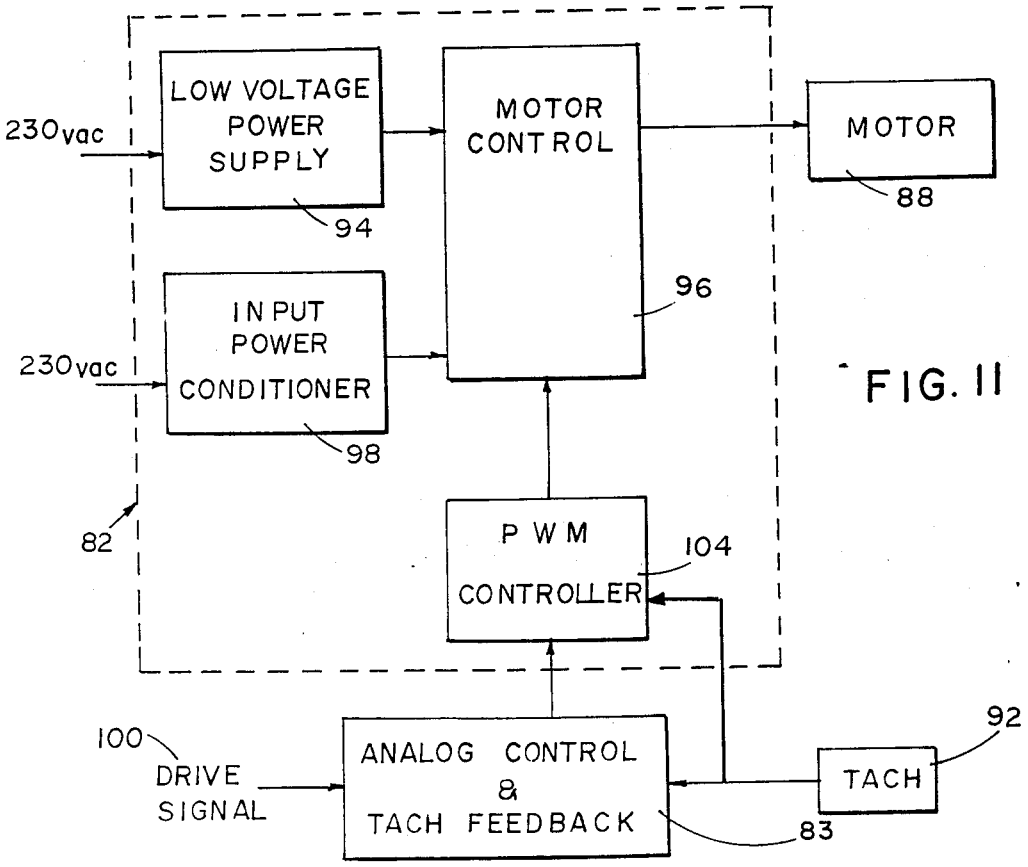
FIG. 11 is a schematic diagram of the vehicle power control circuit.

The motor drive module 82 is illustrated in greater detail in FIG. 11. The low voltage power supply (LVPS) 94 conditions the 230-volt AC input voltage to unregulated and regulated voltage levels required to power the electronic circuits within the motor control 96. EMI filtering is supplied to minimize power switching noise returning to the main power system. The unregulated voltage charges a power interrupt capacitor to provide limited power in case of power loss.

The input power conditioner (IPC) 98 converts the three-phase AC voltage into full-wave DC voltage, filters the DC voltage, and provides transient protection for the motor control electronics. The resulting DC voltage is applied to the drive motor under control of the PWM controller circuitry within the motor control 96.

The motor control 96 (FIG. 11) is a closed loop, supply-on-demand regulator. For example, the control loop process begins with the CPUM 80 (see also FIG. 8) outputting a command signal 100 to the analog control and tach feedback circuitry 102. If the vehicle is initially stopped, the PWM controller 104 begins generating a maximum slew angle (180 degrees) pulse train to the motor control 96. The motor control in turn produces a proportional, high voltage DC that is applied to the drive servo motor 88. Once the motor begins driving, the tachometer 92 generates a DC voltage proportional to the motor RPM. The tachometer feedback is summed by the analog control 102 with the analog command 100 to produce a controlled PWM closed loop servo system. When the motor achieves the commanded RPM as sensed by the tachometer 92, the servo loop maintains this RPM under changing vehicle load conditions. During deceleration or braking, the motor drive module 82 provides dynamic braking as the drive motor 88 is shorted through a low-impedance load in a controlled fashion.

VI. Assembly and Operation Summary

The layout of the track network 12 is dictated by the material transportation requirements in the factory. Specifically, the track must interface with robots, PLC's, machine tools, automatic storage and retrieval systems, and personnel to properly convey the articles through the factory network. Once the track design has been laid out as illustrated for example in FIG. 1, the track zone functions are selected to implement the track layout. The selection of appropriate functions is readily apparent from the above description with three exemplary layouts being provided in FIGS. 6–9. After the functions are selected, the CPC 62 and the BCC's 66 (FIG. 6) are loaded with information and tables indicating the configuration of the system. The BCC and/or CPC tables can be easily reconfigured to meet changing requirements in the facility in which the system 10 is installed.

During operation, the CPC 62 (FIG. 6) is informed of the identity of all vehicles within the system 10. This enables the CPC to maintain its vehicle tables as discussed above to update information regarding the location of all vehicles, and their desired destinations, enabling the CPC to make routing decisions based on, for example, operator input, a prestored file, or a factory network link. As the vehicles traverse the conveyor track network 12, their positions are continually monitored by the individual BCC's 66 to prevent intercarrier collisions and to make switching decisions to route each vehicle to its desired destination. Information passes within the system from the CPC 62 to the vehicles 14 through the BCC's 66. Similarly, information passes from the vehicles 14 to the CPC 62 also through the BCC's 66. Information passed between the vehicles 14 and the BCC's 66 is stored in the appropriate locations within the zone tables maintained by the BCC's. This information is conveyed to the CPC 62 upon request to upload all block status information. Blocking to prevent intervehicle collisions and switching are performed entirely by the BCC's 66 in response to the real-time track status.

Additionally, the CPC is capable of recording a log of information received from the on-board vehicle sensors regarding materials moving through the system. For example, through the strain gauge 44 (see FIGS. 4 and 5) located on each product carrier, the CPC can acquire information regarding the weight of material moved by each product carrier. The CPC 62 is therefore capable of maintaining a log with a "time-and-date stamp", for example, by vehicle, load weight, load type, start station, destination station, or any intermediate station. This enables management personnel to review a manufacturing summary, such as a material weight transportation summary, and evaluate the throughput and efficiency of the system.

Finally, the system provides digital speed control to provide a desired acceleration/deceleration curve. This control of the vehicle speed enables the vehicles to be moved at optimal speeds through the system while preventing lurches and other sudden variations in the vehicle speed which might displace or damage the load. Further preferably, the speed control is responsive to the load weight and/or load type on each vehicle to effect further optimization of speed.

The system preferably further includes (1) extensive error checking for all communications between system components and (2) error handling routines to be entered when errors are detected. Such error checking and handling are within the capabilities of one of ordinary skill in the art and therefore will not be described herein.

The software for implementing the described system is also within the capabilities of one having ordinary skill in the art. Such software for the CPC 62, the BCC's 66, and the vehicles 14 is currently being developed by the assignee of the present invention.

The above description is that of a preferred embodiment of the invention. Various alterations and changes can be made without departing from the spirit and broader aspects of the invention as set forth in the appended claims, which are to be interpreted in accordance with the principles of patent law including the Doctrine of Equivalents.

The embodiments of the invention in which an exclusive property or privilege is claimed are defined as follows:

1. A computer-controlled overhead conveyor system comprising:

a plurality of conveyor track segments joined together to form a track system including identification means associated with each track segment for identifying each track segment;

a plurality of self-propelled vehicles confined to travel along said track system, each vehicle including reader means for reading said track segment identification means and storage means for storing the identification information;

computer control means for controlling the movement of said vehicles along said track system, said control means including memory means for storing information corresponding to each vehicle including the track segment on which each vehicle is located; and a substantially continuous communication means extending along said track system and coupled to said control means, each of said vehicles being coupled to said communication means, said communication means enabling said control means to poll each vehicle individually at substantially any location in the track system and further enabling each of said vehicles to transmit its current track location in response to the polling for storage in said memory means.

2. A conveyor system as defined in claim 1 wherein said communication means comprises a communication bus, each vehicle including means for operatively coupling the vehicle to said bus.

3. A conveyor system as defined in claim 1 wherein each track identification means comprises an optical bar code secured to said track segment, and wherein each of said reading means comprises an optical bar code reader.

4. A conveyor system as defined in claim 1 wherein said computer control means comprises:

a plurality of slave computers each corresponding to a plurality of contiguous track segments; and a master computer, said slave computers being responsive to said master computer; and further wherein said communication means comprises:

a plurality of communication buses each corresponding to one of said slave computers and to the track segments associated therewith, said master computer communicating with said vehicles through said slave computers.

5. A conveyor system as defined in claim 1 wherein each vehicle includes:

timer means for timing the elapsed time after the vehicle is polled; and means for emitting a signal when a predetermined period of time elapses before the vehicle is polled again.

6. A conveyor system as defined in claim 5 further comprising stopping means responsive to the signal for stopping the vehicle when the signal is detected.

7. A conveyor system as defined in claim 1 wherein selected one of said vehicles includes scale means for sensing the weight of a load transported by said vehicle, and further wherein at least one of said control means and said selected vehicles include means for modifying the desired vehicle speed as a function of the load weight.

8. A computer-controlled conveyor system comprising:

a conveyor path including a plurality of subpaths;

a plurality of self-propelled vehicles confined to said conveyor path, each vehicle including means for determining the location of the vehicle with respect to said conveyor path;

switching means coupled to said conveyor path for routing each vehicle between and along selected subpaths of said conveyor path;

control means coupled to said switching means for controlling said switching means; and communication means extending substantially continuously along said conveyor path for permitting said control means to poll said vehicles as substantially any time to ascertain the locations of said vehicles enabling said control means to make switching decisions in controlling said switching means to route each vehicle along selected subpaths.

9. A conveyor system as defined in claim 8 wherein said communication means comprises a bus means, each vehicle including means for coupling said vehicle to said bus means.

10. A conveyor system as defined in claim 9 wherein:

said conveyor path includes a plurality of blocks each of which includes a plurality of zones;

said bus means includes a plurality of block buses each corresponding to a block; and said control means including a plurality of block computers each corresponding to one of said block buses, said control means further including a central computer coupled to said block computers to provide system control of said vehicles through said block computers.

11. A conveyor system as defined in claim 10 wherein said vehicle-location-determining means comprises each of said zones including identification means for identifying the zone, said vehicles including reader means for reading said zone identification means as said vehicles traverse said conveyor path.

12. A conveyor system as defined in claim 8 wherein said vehicle-location-determining means comprises each of said zones including identification means for identifying the zone, said vehicles including reader means for reading said zone identification means as said vehicles traverse said conveyor path.

13. A conveyor system as defined in claim 8 wherein each of said vehicles further includes:

an on-board timer means for measuring the elapsed time after the vehicle is polled by said control means; and warning means responsive to said timer means for generating a warning signal whenever said timer means indicates that an undesirably long time has elapsed after the last polling and before a repolling.

14. A conveyor system as defined in claim 8 wherein each vehicle includes storage means for storing information indicative of a desired destination for the vehicle, and further wherein said control means can ascertain and change the desired destination from the vehicle as substantially any location along said conveyor path, enabling said control means to control said switching means to deliver the vehicle to its desired destination.

15. A conveyor system comprising:

path means for defining a conveyor path having a plurality of subpaths;

a plurality of vehicles for transporting material, said vehicles being confined to travel along said path means, each of said vehicles including sensor means for producing a signal at any point along the conveyor path representative of a characteristic of the material;

communication means for communicating the signals to a computer means; and computer means for receiving the signals from the individual vehicles via the communication means, said computer means including routing means for making routing decisions for each vehicle between selected subpaths based on the signals.

16. A conveyor system as defined in claim 15 wherein the characteristic is weight.

17. A conveyor system as defined in claim 15 wherein said communication means comprises:

a communication bus coupled to said computer means and extending substantially continuously along said path means; and connector means for interconnecting each of said vehicles and said bus.

18. A conveyor system as defined in claim 16 wherein each of said vehicles includes:

vehicle means for following said path means as said vehicle travels along said path means;

connecting means for releasably engaging a load to be transported; and said sensor means being located between said vehicle means and said connect means, said sensor means measuring the force between said vehicle means and said connect means.

19. A conveyor system as defined in claim 16 wherein at least one of said computer means and selected ones of said vehicles includes throttle means for regulating the speed of said vehicles, and further wherein said throttle means is responsive to said sensor means to control the vehicle speed as a function of the load force.

20. A conveyor system as defined in claim 16 wherein said sensor means comprises a strain gage.

21. A conveyor system as defined in claim 18 wherein said path means comprises an overhead track means, and further wherein said connect means is suspended from said vehicle means.

22. A conveyor system as defined in claim 15 wherein each of said vehicles is self-propelled.

23. An overhead conveyor system capable of monitoring the weight of materials moved thereby, said system comprising:

an overhead conveyor track system;

a plurality of self-propelled vehicles confined to said track system, each of said vehicles including vehicle means for driving the vehicle along the track system, coupling means for coupling a load to the vehicle, weight-sensing means for providing a signal indicative of the weight of the load, and storage means for storing information including a vehicle number and a load weight number;

communication means for enabling a computer to read the information stored in each vehicle; and computer means coupled to said communication means for polling said vehicles via said communication means to read the information stored in each vehicle.

24. An overhead conveyor system as defined in claim 21 wherein said communication means comprises a communication bus extending substantially continuously along said track system, said bus being connected to said computer means.

25. An overhead conveyor system as defined in claim 21 wherein said weight-sensing means comprises a strain gage located between said vehicle means and said coupling means.

26. A computer-controlled conveyor system comprising:

a conveyor path;

a plurality of vehicles confined to said path and capable of traveling at independent speeds therealong, said vehicles transporting loads of different weights, each of said vehicles including scale means for indicating the weight of the vehicle load; and digital control means for controlling the speed of each of said vehicles independently, said control means being responsive to said scale means so that the speed of each vehicle is a function of the weight of the vehicle load.

27. A conveyor system as defined in claim 26 wherein said vehicles transport loads of different types, and further wherein at least one of said each vehicle and said control means includes indicator means for indicating the type of each vehicle load, and further wherein said control means is responsive to said indicator means so that the speed of each vehicle is a function of the type of the vehicle load.

28. A computer-controlled conveyor system comprising:

a conveyor path;

a plurality of vehicles confined to said path and capable of traveling at independent speeds therealong, said vehicles transporting loads of different types, at least one of said each vehicle and said control means including indicator means for indicating the type of each vehicle load; and digital control means for controlling the speed of each of said vehicles independently, said control means being responsive to said indicator means so that the speed of each vehicle is a function of the type of the vehicle load.

* * * * *

UNITED STATES PATENT AND TRADEMARK OFFICE

CERTIFICATE OF CORRECTION

PATENT NO. : 4,766,547

DATED : August 23, 1988

INVENTOR(S) : Richard G. Modery et al

It is certified that error appears in the above-identified patent and that said Letters Patent is hereby corrected as shown below:

Column 6, line 10:
"vla" should be --via--

Column 6, line 24:
"erors" should be --errors--

Column 8, line 31:
insert --.-- after "activation"

Column 10, line 32:
"," should be --.--

Column 10, line 52:
"Stopping" should be --Stopping--

Column 16, line 28:
"as" should be --at--

Column 17, line 9:
"as" should be --at--

UNITED STATES PATENT AND TRADEMARK OFFICE

CERTIFICATE OF CORRECTION

PATENT NO. : 4,766,547

DATED : August 23, 1988

INVENTOR(S) : Richard G. Modery et al.

It is certified that error appears in the above-identified patent and that said Letters Patent is hereby corrected as shown below:

Column 17, line 59:

insert --conveyor-- after "overhead"

Signed and Sealed this

Sixteenth Day of May, 1989

*Attest:*

DONALD J. QUIGG

*Attesting Officer*

*Commissioner of Patents and Trademarks*